US005893240A

United States Patent [19]

Ealer, Sr.

[11] Patent Number: 5,893,240

[45] Date of Patent: Apr. 13, 1999

[54] GUTTER SCREEN

[76] Inventor: James Edward Ealer, Sr., 150 Hwy. WW, St. Clair, Mo. 63077

[21] Appl. No.: 08/796,712

[22] Filed: Feb. 6, 1997

Related U.S. Application Data

[XX .

[60] Provisional application No. 60/011,514, Feb. 12, 1996.

[51] Int. Cl.[6] ..... E04D 13/064

[52] U.S. Cl. ..... 52/12; 248/48.2; 52/11

[58] Field of Search ..... 52/11, 12, 15, 52/16; 248/48.1, 48.2

[56] References Cited

U.S. PATENT DOCUMENTS

| | | | |
|---|---|---|---|
| 1,597,503 | 8/1926 | Andrews | 52/12 |
| 2,175,521 | 10/1939 | Fry | 52/12 |
| 2,209,741 | 7/1940 | Sullivan et al. | 52/11 X |
| 2,988,226 | 6/1961 | Campbell | 52/12 X |
| 3,067,881 | 12/1962 | Goosmann | 52/12 X |
| 3,351,206 | 11/1967 | Wennerstrom | 52/12 X |
| 4,307,976 | 12/1981 | Butler | 405/118 |
| 4,750,300 | 6/1988 | Winger, Jr. | 52/12 |
| 4,769,957 | 9/1988 | Knowles | 52/12 |
| 4,796,390 | 1/1989 | Demartini | 52/12 |
| 4,907,381 | 3/1990 | Ealer | 52/12 |
| 4,936,061 | 6/1990 | Palma | 52/12 |
| 4,941,299 | 7/1990 | Sweers | 52/12 |
| 5,072,551 | 12/1991 | Manoogian, Jr. | 52/12 |
| 5,092,086 | 3/1992 | Rognsvoog, Sr. | 52/12 |
| 5,109,640 | 5/1992 | Creson | 52/12 |
| 5,271,192 | 12/1993 | Nothum, Sr. et al. | 52/12 |
| 5,438,803 | 8/1995 | Blizard, Jr. | 52/12 |
| 5,619,825 | 4/1997 | Leroney et al. | 52/12 |

OTHER PUBLICATIONS

Gutter World, Inc., "Hinged Gutter Guard, Drop–In Gutter Guard Price List," 1985, pp. 1–4.

Gutter World, Inc., "The Ultimate Guards," 1985, pp. 1–2.

*Primary Examiner*—Carl D. Friedman

*Assistant Examiner*—Winnie Yip

*Attorney, Agent, or Firm*—Senniger, Powers, Leavitt & Roedel

[57] ABSTRACT

A gutter screen adapted for covering a gutter having a flange projecting rearwardly from an upper edge of a front wall of the gutter. The gutter is supported by at least one gutter hanger having a hook portion for hooking over a back wall of the gutter, a bridging portion extending forward from the hook portion, and a front portion extending up from the bridging portion for engagement with the front flange of the gutter. The hook and bridging portions define a first corner. The gutter screen comprises an elongate screen member having a central portion and front and rear edge margins. The configuration of the screen member is such that when the screen member is unstressed, the central portion and front edge margin combine to form a flat continuous unbent generally planar stretch of screen, and the rear edge margin is bent so that it extends downwardly from the central portion. When installed in a gutter the screen member is resiliently bent to an arcuate configuration wherein the front edge margin of the screen member is adapted for pressure engagement with a rearward edge portion of the gutter flange, the front edge is adapted to engage the gutter hanger, and the rear edge margin is adapted for pressure engagement with the first corner of the hanger. The pressure engagement of the screen member with the gutter flange and gutter hanger serve to releasably hold the gutter screen in an arched position over the gutter.

13 Claims, 8 Drawing Sheets

GUTTER SCREEN

This application claims benefit of Provisional Application Ser. No. 60/011,514, filed Feb. 12, 1996.

BACKGROUND OF THE INVENTION

This invention relates generally to rain gutters and more particularly to a gutter screen for such gutters. Since leaves and other debris frequently clog up rain gutters, some kind of guard or screen which prevents leaves from falling into the gutter is desirable. However, conventional gutter screens may become overburdened by such debris and collapse into the gutter, thereby aggravating the problem instead of solving it.

Conventional gutter screens have a channel-shaped member along the front edge of the gutter screen for receiving a flange bent rearwardly from the top of the front wall of the gutter thereby to hold the screen loosely in place on the gutter. However, as leaves and other debris pile up on this gutter screen, the center of the screen typically begins to bow down until finally the entire gutter screen collapses into the gutter. In addition, since the gutter screen collapses into the gutter, it may become loose and fall off in high winds or be forced off by the action of small animals.

Prior art gutter screens which are designed to be securely held in place typically require a complex bend such as a V-shaped or U-shaped bend at one end of the gutter screen to mate with a gutter hanger or they may require a modified gutter hanger to interengage with the gutter screen to lock the gutter screen in place. These gutter screens or modified gutter hangers are expensive to manufacture and require significant time to install or remove. Moreover, the bend must be consistently formed to mate with specific gutter hangers. Consequently, manufacturing tolerances must be small.

Accordingly, there is presently the need for a gutter hanger which is inexpensive to manufacture and easy to install on various types of gutter hangers.

SUMMARY OF THE INVENTION

Among the several objects of this invention may be noted the provision of an improved gutter screen that is simple and inexpensive to manufacture; the provision of a gutter screen which is compatible with various configurations of gutters; the provision of a gutter screen which is easy to install and replace; the provision of a gutter screen which keeps leaves and other solid matter out of the gutter to prevent clogging of the gutter; and the provision of a gutter screen which is not likely to collapse under the weight of leaves and debris and which is securely connected to the gutter.

Generally, a gutter screen of this invention is adapted for covering a gutter and preventing leaves and the like from falling into the gutter. The gutter has front, back and bottom walls and a front flange projecting rearwardly from an upper edge of the front wall of the gutter and extends substantially continuously along the entire length of the gutter. The gutter is supported by at least one gutter hanger having a hook portion for hooking over the back wall of the gutter, a bridging portion extending forward from the hook portion over the bottom of the gutter to a position generally adjacent the front wall of the gutter, and a front portion extending up from the bridging portion for engagement with the front flange of the gutter. The hook and bridging portions are joined to define a first corner adjacent the rear wall of the gutter. The gutter screen comprises an elongate screen member having, as viewed from an end of the screen member, a central portion and integrally formed front and rear edge margins on opposite sides of the central portion terminating in front and rear edges, respectively. The configuration of the screen member is such that when the screen member is unstressed, the central portion and front edge margin of the screen member combine to form a flat continuous unbent generally planar stretch of screen reaching across the central portion and the front edge margin all the way to the front edge of the screen member, and the rear edge margin is bent with respect to the central portion so that it extends downwardly from the central portion to form a continuous unbent generally planar stretch of screen reaching from the central portion all the way to said rear edge of the screen member. When unstressed, the screen member has a width greater than the horizontal distance between the first corner of the hanger and the front flange of the gutter so that the screen member may be resiliently bent to an arcuate configuration and installed in the gutter in a position wherein the front edge margin of the screen member is adapted for pressure engagement with a rearward edge portion of the gutter flange along a line of engagement spaced rearwardly from the forward edge of the screen member, the front edge of the gutter screen is adapted to engage the gutter hanger, and the rear edge margin of the screen member is adapted for pressure engagement with the first corner of the hanger adjacent the rear wall of the gutter. The pressure engagement of the screen member with the gutter flange and with the gutter hanger serves to releasably hold the gutter screen in an arched position over the gutter.

In another embodiment of this invention, a gutter screen has a configuration such that when the screen member is unstressed, the central portion, front edge margin and rear edge margin of the screen member combine to form a flat continuous unbent generally planar stretch of screen reaching across the screen member.

In another embodiment of this invention, a gutter screen is configured such that when the screen member is unstressed, the front edge margin is bent with respect to the central portion so that it extends downwardly from the central portion to form a continuous unbent generally planar stretch of screen reaching from the central portion all the way to the front edge of the screen member, and the rear edge margin is bent at an obtuse angle with respect to the central portion so that it extends downwardly from the central portion to form a continuous unbent generally planar stretch of screen reaching from the central portion all the way to the rear edge of the screen member.

In another embodiment of this invention, a gutter screen is configured such that when the screen member is unstressed, the front edge margin is bent with respect to the central portion so that it extends downwardly from the central portion to form a continuous unbent generally planar stretch of screen reaching from the central portion all the way to the front edge of the screen member and the rear edge margin is bent at an obtuse angle with respect to the central portion so that it extends downwardly from the central portion to form a continuous unbent generally planar stretch of screen reaching from the central portion all the way to the rear edge of the screen member. The central portion of the screen member is adapted for pressure engagement with a rearward edge portion of the gutter flange.

In another embodiment, a gutter screen is configured such that when the screen member is unstressed, the front edge margin is bent with respect to the central portion so that it extends downwardly from the central portion to form a continuous unbent generally planar stretch of screen reaching from the central portion all the way to the front edge of the screen member and the rear edge margin and central portion combine to form a flat continuous unbent generally planar stretch of screen reaching from the front edge margin across the central portion all the way to the rear edge of the screen member. The central portion of the screen member is adapted for pressure engagement with a rearward edge portion of the gutter flange.

In yet another embodiment of the present invention, a gutter screen includes a front edge margin having three bends therein forming two risers and an upwardly facing connecting portion connecting the two riser portions. The front edge of the gutter screen is adapted to engage the gutter hanger and the rear edge margin is adapted for pressure engagement with the first corner of the hanger adjacent the rear wall of the gutter.

Other objects and features will be in part apparent and in part pointed out hereinafter.

BRIEF DESCRIPTION OF THE DRAWING

Corresponding reference characters indicate corresponding part throughout the several views of the drawings.

DETAILED DESCRIPTION OF THE PREFERRED EMBODIMENTS

Figure 1:
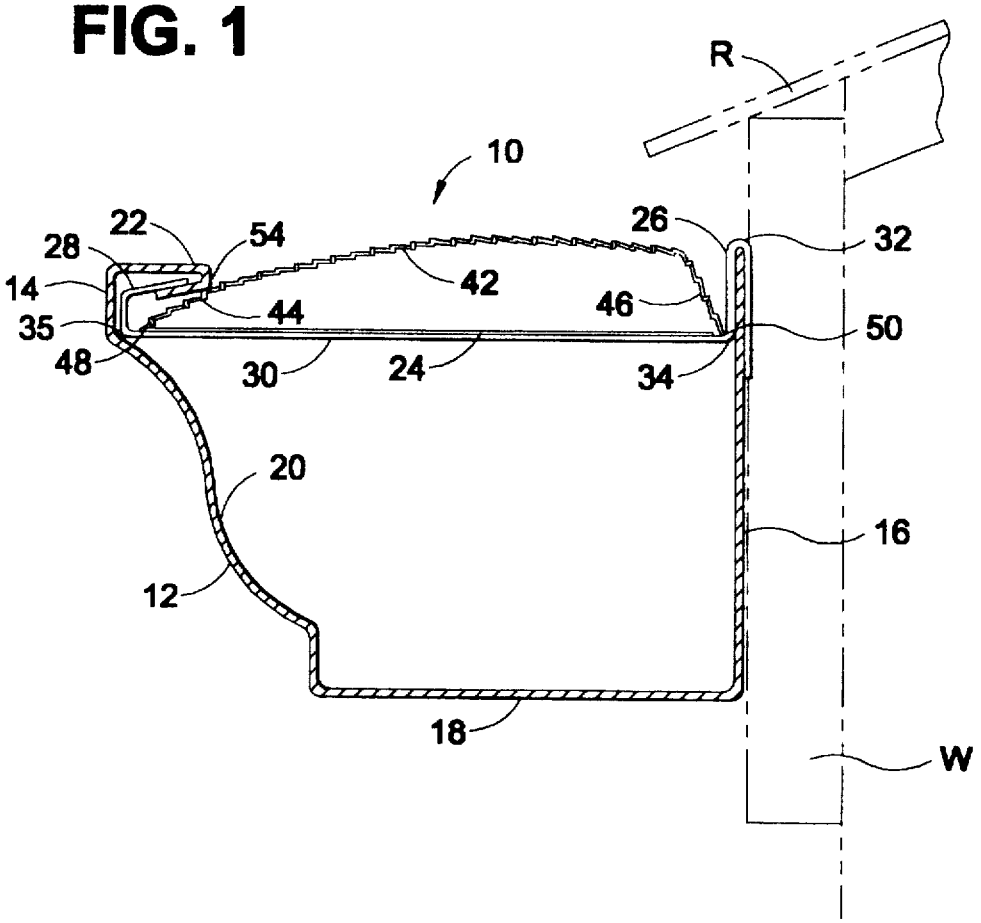
FIG. 1 is a transverse cross-sectional view of a gutter screen of the present invention installed on a gutter.

Referring now to the drawings, and first to FIG. 1, a gutter screen is generally indicated at 10. The gutter screen 10 of this invention is adapted for covering a gutter 12 and preventing leaves and the like from falling into the gutter. The gutter 12 has a front wall 14, a back wall 16 and a bottom wall 18 which combine to form a channel 20 for drainage of water. A flange 22 projects rearwardly from the upper edge of the front wall 14 of the gutter 12 and extends substantially continuously along the entire length of the gutter 12. The flange 22 strengthens the gutter 12 and provides a smooth top edge to the front wall 14.

The gutter 12 is attached to the outside wall W of a building by at least one gutter hanger 24. The gutter hanger 24 may vary in shape in size. The gutter hanger 24 extends forwardly from the back wall 16 of the gutter 12 to a position under the gutter flange 22. The hanger 24 has a back hook portion 26, front portion 28 and bridging portion 30 which extends over the channel 20 of the gutter 12 (see also FIG. 3A). The hook portion 26 of the hanger 24 is bent at its upper end 32 for hooking over the back wall 16 of the gutter 12. The bridging portion 30 extends forward from the hook portion 26 over the bottom 18 of the gutter 12 to a position generally adjacent the front wall 14 of the gutter. The front portion 28 of the hanger 24 extends up from the bridging portion 30 and is bent to fit inside the flange 22 of the gutter 12. The hook and bridging portions 26, 30 are joined to define a first (rear) corner 34 adjacent the back wall 16 of the gutter 12. The front and hook portions 28, 26 are joined to define a second (front) corner 35 adjacent the front wall of the gutter. The hanger 24 includes an opening (not shown) for receiving a fastener, such as a screw or nail, to secure the gutter to wall W adjacent a roof R. The hanger 24 supports the front wall 14 of the gutter 12 and reinforces it against inwardly directed pressures, such as are frequently caused by ladders leaning against the gutter, and outwardly directed forces, such as caused by someone pulling on the gutter while climbing onto the roof.

The gutter screen 10 comprises a flexible resilient screen member having a central portion 42 and front and rear edge margins 44, 46 on opposite sides of the central portion terminating in front and rear edges 48, 50 respectively. Preferably, the front and rear edge margins 44, 46 are integrally formed with the central portion 42 and extend generally parallel to one another. The edge margins 44, 46 may be bent in various configurations to form the embodiments shown in FIGS. 1–8. The screen member is adapted to be resiliently bent to a configuration in which the front edge margin 44 and rear edge margin 46 of the screen member are adapted for pressure engagement with the gutter 12 and gutter hanger 24 thereby to securely maintain the gutter screen 10 on the gutter 12. The gutter screen 10 is formed of a flexible resilient metal, such as an aluminum or steel alloy, and is of integral construction, formed from a single continuous section of screening. The gutter screen 10 includes strands of wire interwoven with one another to form a unitary wire mesh screen.

Figure 1A:
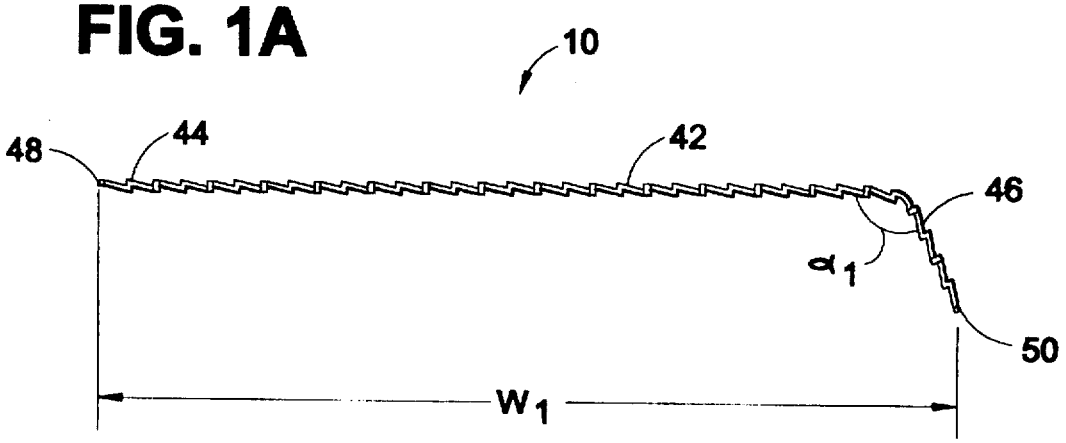
FIG. 1A is a transverse cross-sectional view of the gutter screen of FIG. 1.

The configuration of the gutter screen 10 of FIG. 1 is such that when the screen member is unstressed (FIG. 1A), the central portion 42 and front edge margin 44 of the screen member combine to form a flat continuous unbent generally planar stretch reaching across the central portion and the front edge margin all the way to the front edge 48 of the screen member. The rear edge margin 46 is bent with respect to the central portion 42 so that it extends downwardly from the central portion to form a continuous unbent generally planar stretch reaching from the central portion all the way to the rear (lower) edge 50 of the screen member. The rear edge margin 46 is preferably roll formed to define an angle $\alpha_1$ of between 100 and 120 degrees with respect to the central portion.

The width $W_1$, of the gutter screen 10 (i.e., from the front edge 48 to the rear edge 50) is preferably greater than the width of the gutter 12 (i.e., between the first corner 34 of the hanger 24 and flange of the gutter 22) so that the screen may be resiliently bent to the arcuate configurations shown in FIG. 1, wherein the front edge margin 44 and rear edge margin 46 of the screen member are in pressure (spring-like) engagement with the gutter 12 and gutter hanger 24, respectively, thereby to securely maintain the gutter screen on the gutter until such time as it is manually removed. The arched configuration of the screen 10 also increases the load-bearing capability of the screen. When installed in the gutter 12, the front edge margin 44 of the screen member is adapted for pressure engagement with a rearward edge portion 54 of the gutter flange 22 along a line of engagement spaced rearwardly from the forward edge 48 of the screen member (FIG. 1). The front edge 48 of the gutter screen 10 is in pressure engagement with the bridging portion 30 of the gutter hanger 24 and the rear edge 50 of the screen member is in pressure engagement with the rear corner 34 of the gutter hanger adjacent the back wall 16 of the gutter 12. The pressure engagement of the screen member with the gutter flange 22 and gutter hanger 24 serves to releasably hold the gutter screen 10 in an arched position over the gutter 12.

Figure 2:
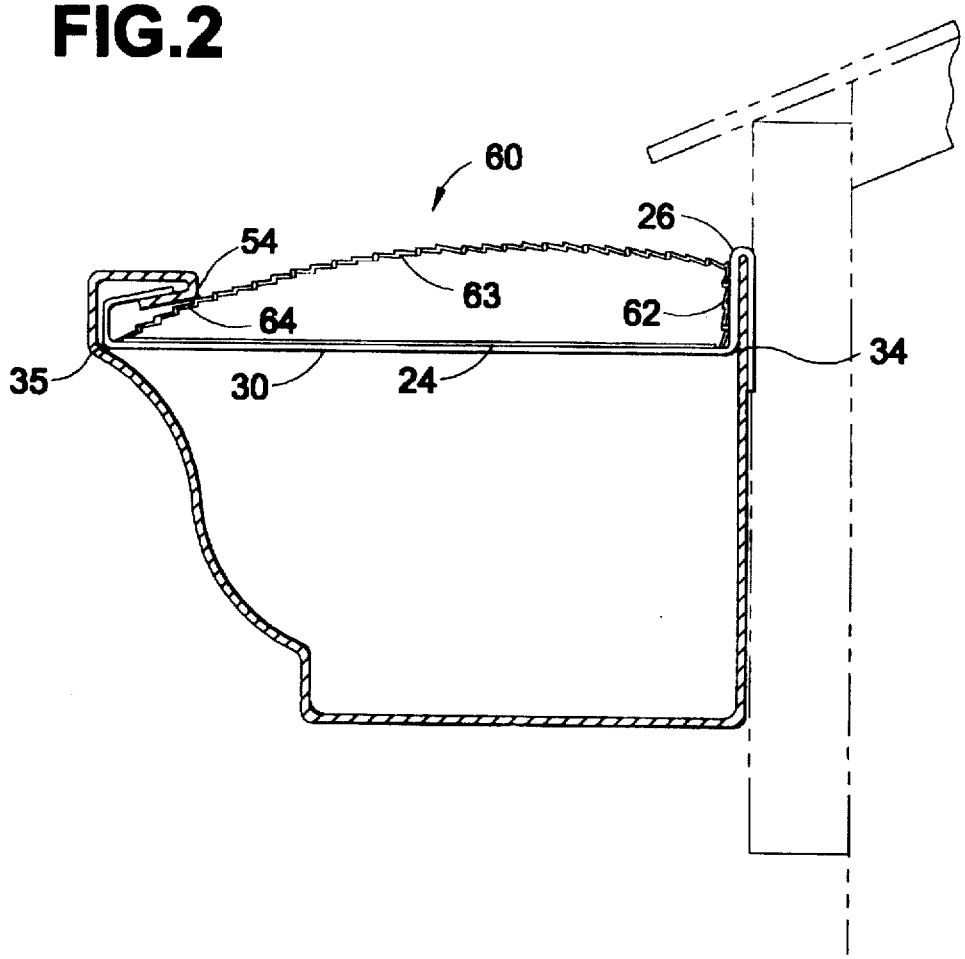
FIG. 2 is a transverse cross-sectional view of a second embodiment of a gutter screen of the present invention installed on a gutter.
Figure 2A:
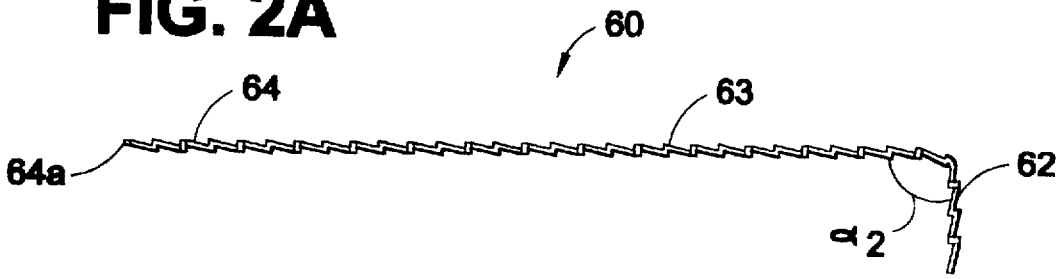
FIG. 2A is a transverse cross-sectional view of the gutter screen of FIG. 2.

A gutter screen of a second embodiment of the present invention is shown in FIGS. 2 and 2A, and generally indicated at 60. The gutter screen 60 is similar to the gutter screen 10 shown in FIG. 1 except the rear edge margin 62 is bent with respect to the central portion 63 at an angle $\alpha_2$ of approximately 90 degrees. When the gutter screen 60 is installed in the gutter 12, the rear edge margin 62 extends generally parallel to the hook portion 26 of the gutter hanger 24. The rear edge margin 62 is in pressure engagement with the hook portion 26 of the gutter hanger 24, in addition to being in pressure engagement with the rear corner 34 of the gutter hanger 24. The front edge 64*a* of the front edge margin 64 of the gutter screen is in pressure engagement with the front portion 28 of the gutter hanger 24. It is to be understood that the width of the central portion of the gutter screens 10, 60 shown in FIGS. 1 and 2 may vary so that the front edge 48, 64 contacts either the bridging portion 30, the front portion 28 or the front corner 35 of the gutter hanger 24.

Figure 3:
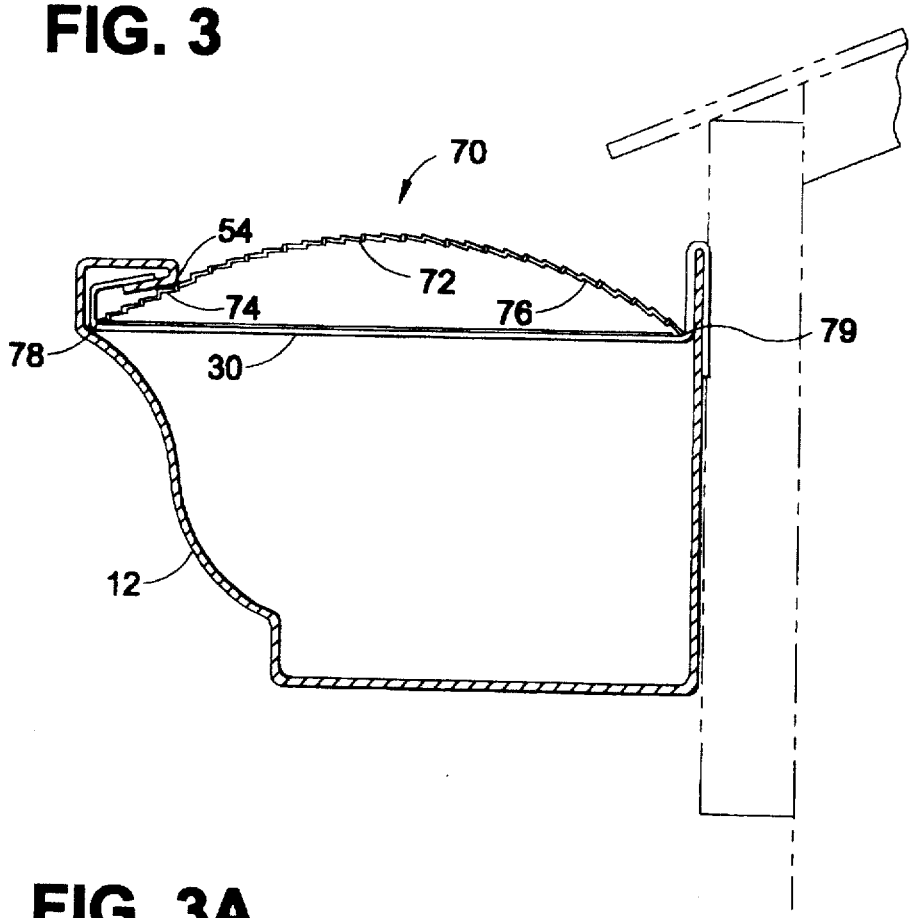
FIG. 3 is a transverse cross-sectional view of a third embodiment of a gutter screen of the present invention installed on a gutter.
Figure 3A:
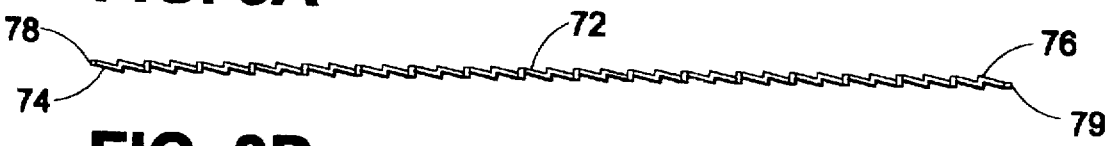
FIG. 3A is a transverse cross-sectional view of the gutter screen of FIG. 3.
Figure 3B:
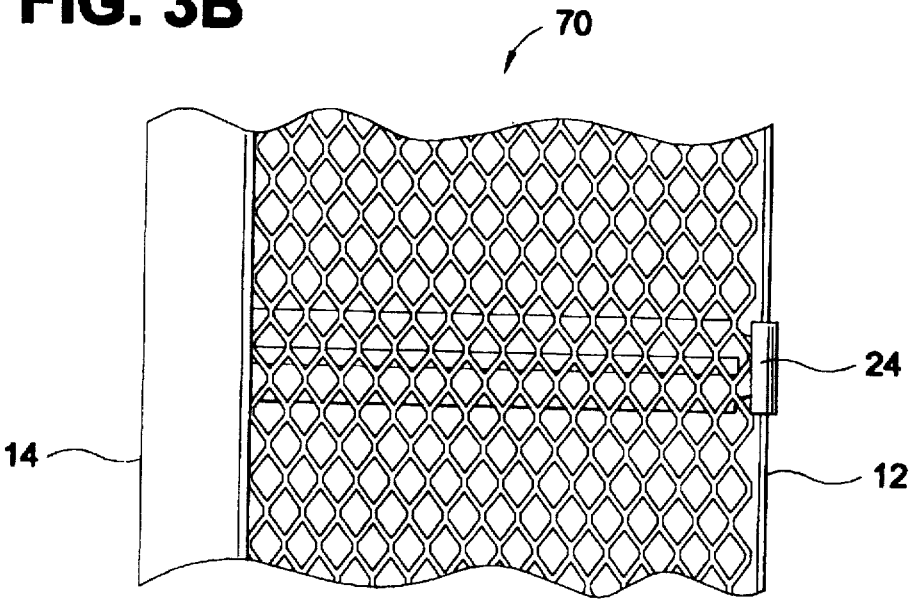
FIG. 3B is a top plan view of the gutter screen and gutter of FIG. 3.

FIGS. 3 and 3A show a third embodiment of a gutter screen, generally indicated at 70. The gutter screen 70 is configured such that when it is unstressed (FIG. 3A), the central portion 72, front edge margin 74 and rear edge margin 76 combine to form a flat continuous unbent generally planar stretch reaching across the member. The front edge margin 74 of the screen member is adapted for pressure engagement with the rearward edge portion 54 of the gutter flange 22 and the front edge 78 is adapted to for pressure engagement with the bridging portion 30 of the gutter hanger 12. The rear edge 79 of the screen member is adapted for pressure engagement with the rear corner 34 of the hanger adjacent the back wall 16 of the gutter 12. A top plan view of the gutter screen 70 installed in a gutter 12 is shown in FIG. 3B.

Figure 4:
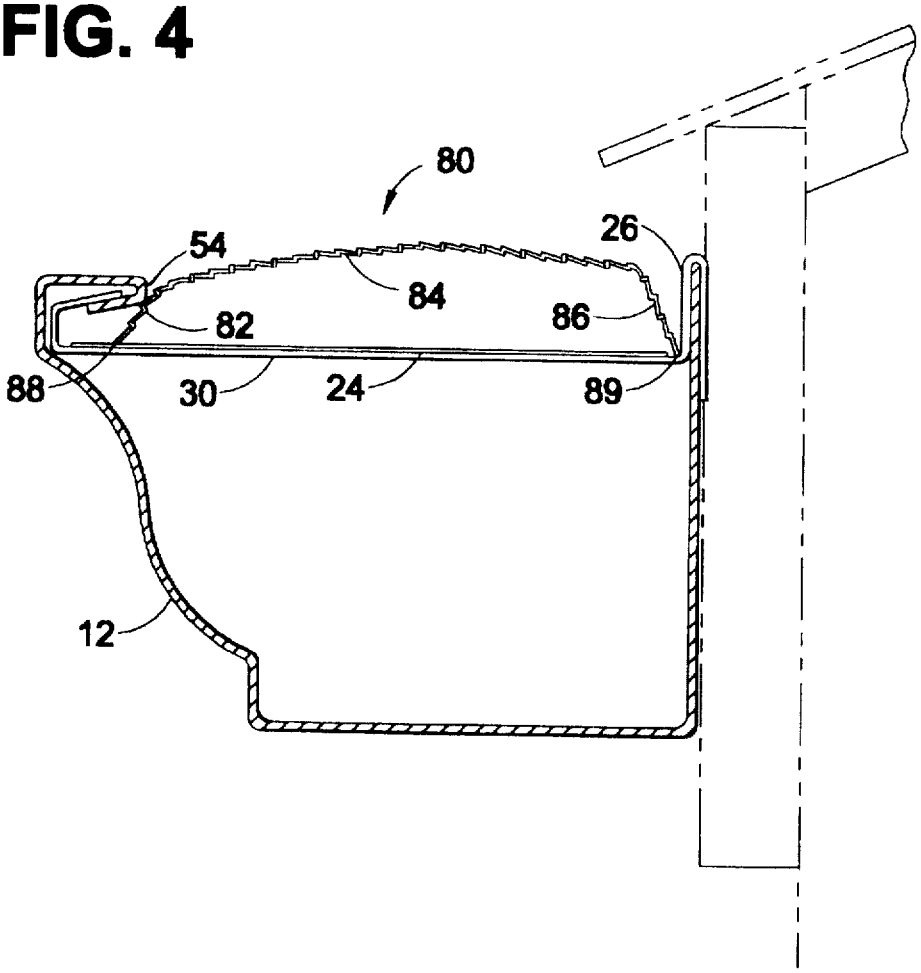
FIG. 4 is a transverse cross-sectional view of a fourth embodiment of a gutter screen of the present invention installed on a gutter.
Figure 4A:
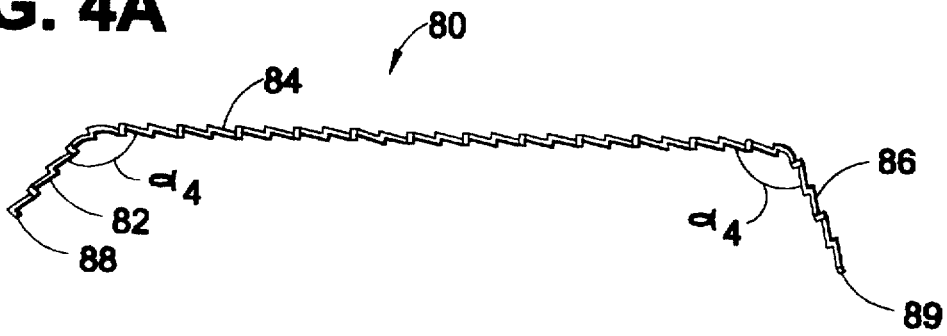
FIG. 4A is a transverse cross-sectional view of the gutter screen of FIG. 4.

A fourth embodiment of a gutter screen, generally indicated at 80, is shown in FIGS. 4 and 4A. When the gutter screen 80 is unstressed (FIG. 4A), the front edge margin 82 is bent with respect to the central portion 84 along a bend line extending lengthwise of the gutter screen so that the front edge margin extends downwardly from the central portion to form a continuous unbent generally planar stretch reaching from the central portion all the way to the front edge 88 of the screen member. The rear edge margin 86 is also bent with respect to the central portion 84 so that it extends downwardly from the central portion to form a continuous unbent generally planar stretch reaching from the central portion all the way to the rear edge 89 of the screen member. The angle $\alpha_3$ between the front edge margin 82 and central portion 84 is preferably between 100 and 120 degrees. The angle $\alpha_4$ between the rear edge margin 86 and central portion 84 is also preferably between 100 and 120 degrees. It is to be understood that the angle of the bends in the rear edge or front edge margin may vary without departing from the scope of this invention.

Figure 5:
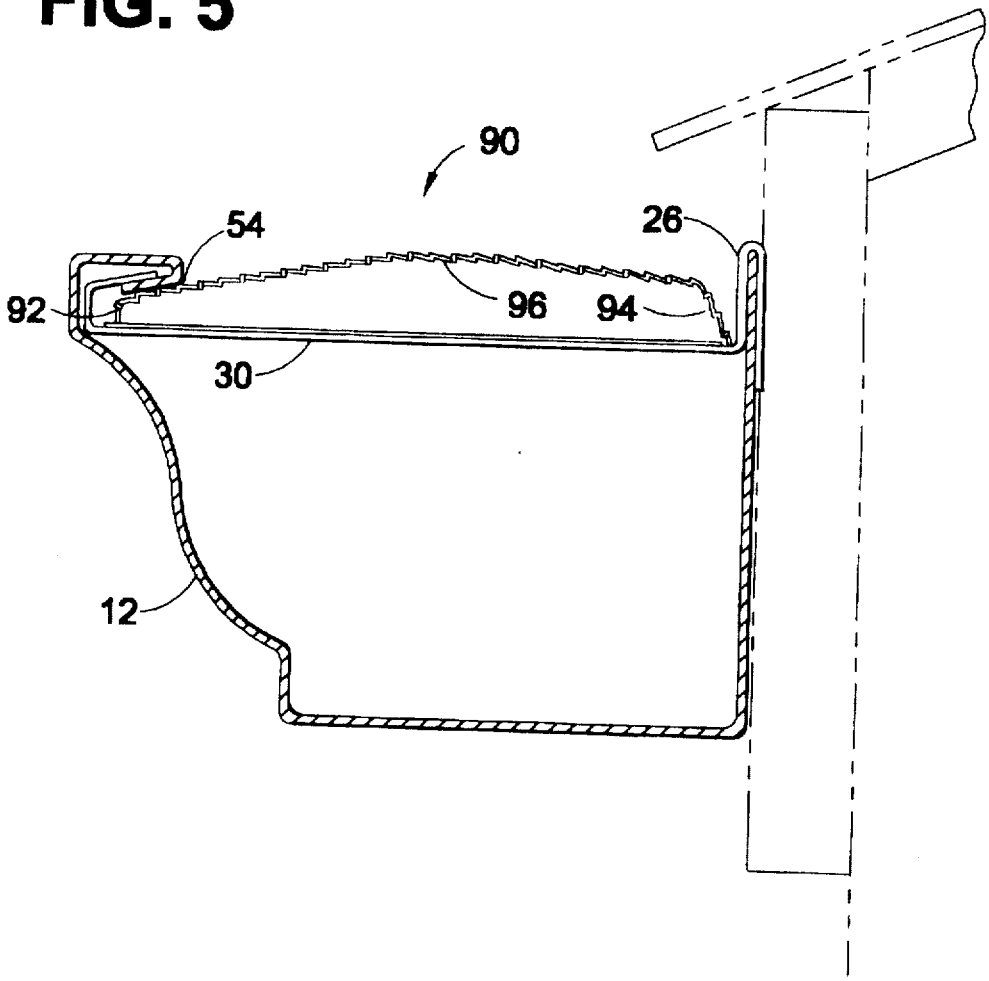
FIG. 5 is a transverse cross-sectional view of a fifth embodiment of a gutter screen of the present invention installed on a gutter.
Figure 5A:
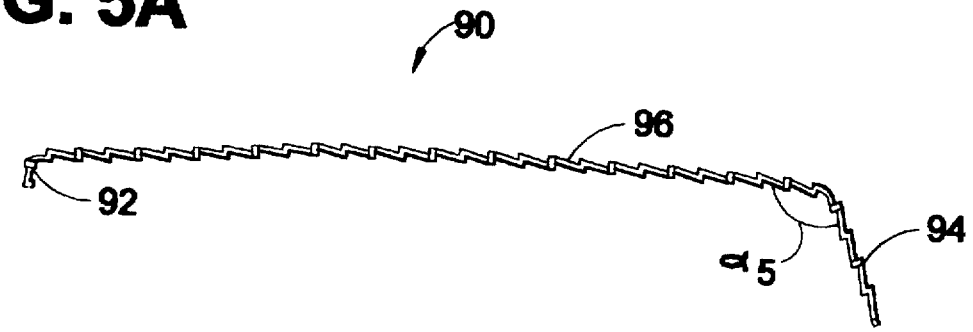
FIG. 5A is a transverse cross-sectional view of the gutter screen of FIG. 5.

A fifth embodiment of a gutter screen of this invention is shown in FIGS. 5 and 5A and generally indicated at 90. The gutter screen 90 is similar to the gutter screen 80 shown in FIG. 4 except that the front edge margin 92 has a length which is shorter than the vertical distance between the bridging portion 30 of the gutter hanger 24 and the front flange 22 of the gutter 12 so that a forward part of the central portion 96 and the front edge margin 92 are disposed underneath the front flange of the gutter when the gutter screen is installed in the gutter. The central portion 96 of the screen member is in pressure engagement with the rearwardly facing flange 22 of the gutter 12. The front edge margin 92 is preferably configured to extend generally perpendicular to the bridging portion 30 of the gutter hanger 24 when installed in the gutter 12. The rear edge margin 94 is preferably bent at an angle $\alpha_5$ of between 100 and 120 degrees with respect to the central portion 96.

Figure 6:
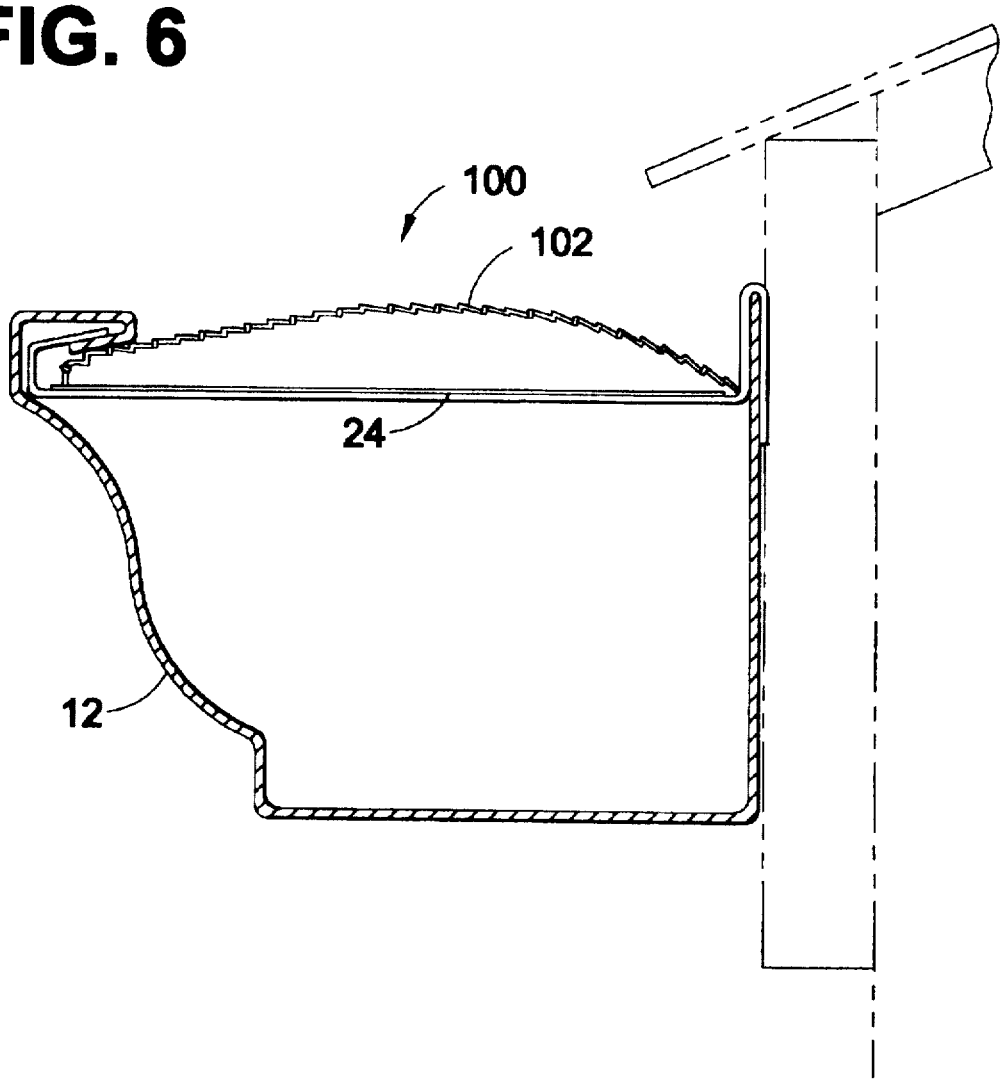
FIG. 6 is a transverse cross-sectional view of a sixth embodiment of a gutter screen of the present invention installed on a gutter.
Figure 6A:
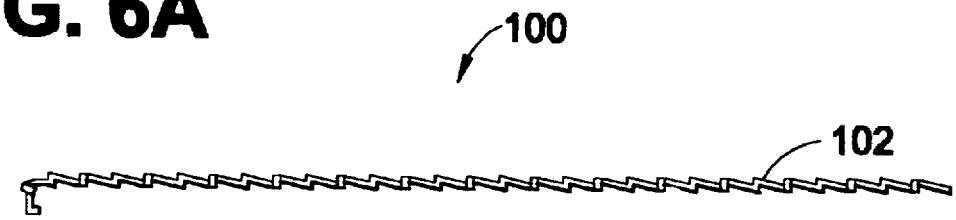
FIG. 6A is a transverse cross-sectional view of the gutter screen of FIG. 6.

FIGS. 6 and 6A show a gutter screen of a sixth embodiment of the present invention, generally indicated at 100. The gutter screen 100 is similar to the gutter screen 90 shown in FIG. 5 except that the rear edge margin 102 does not have a bend.

Figure 7:
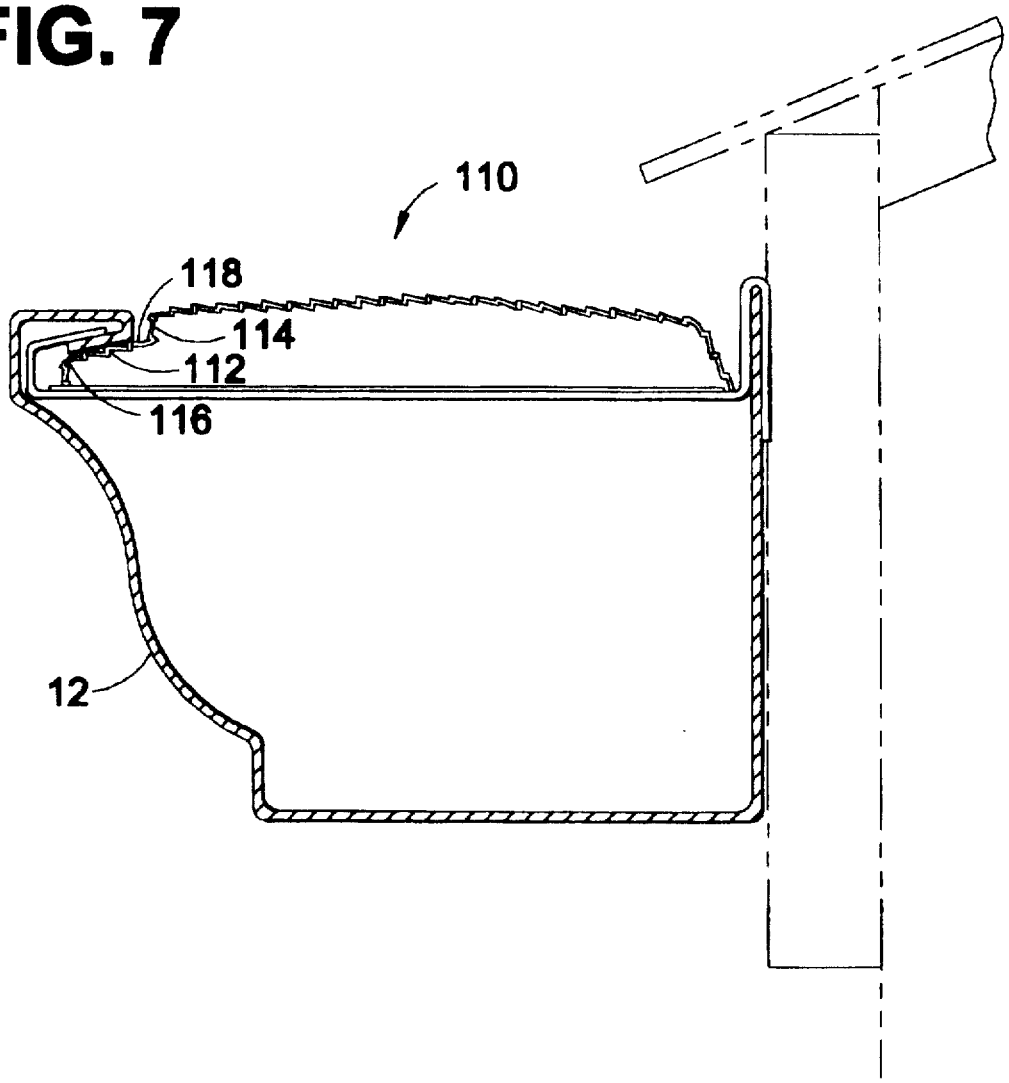
FIG. 7 is a transverse cross-sectional view of a seventh embodiment of a gutter screen of the present invention installed on a gutter.
Figure 7A:
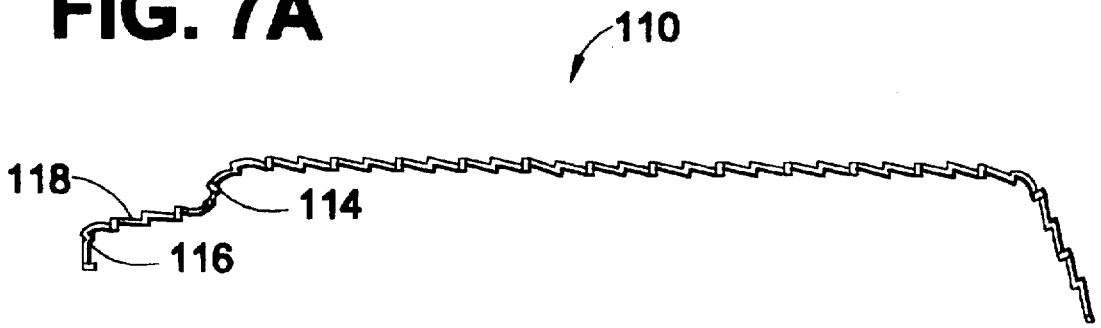
FIG. 7A is a transverse cross-sectional view of the gutter screen of FIG. 7.

A seventh embodiment of a gutter screen is generally indicated at 110 and shown in FIGS. 7 and 7A. The front edge margin 112 has three bends forming back and front riser portions 114, 116 and a upwardly facing connecting portion 118 connecting the two riser portions. The first (back) riser portion 114 is adapted to be disposed rearward of the rearward edge portion 54 of the gutter flange 22 when the gutter screen 110 is installed in the gutter 12. The second (front) riser (lower) portion 116 is configured to extend generally perpendicular to the bridging portion 30 of the gutter hanger 24 when the gutter screen 110 is installed in the gutter 12. This stepped configuration allows the gutter screen to be securely held in place in the gutter. Each bend between the riser portions 114, 116 and connecting portion 118 has an included angle preferably between 90 and 120 degrees so that the riser portions are generally vertical and the upwardly facing connection portion is generally horizontal. It is to be understood that the bend angles of the front edge margin 112 and the length of the riser portions 114, 116 and upwardly facing connection portion 118 may vary without departing from the scope of this invention.

Figure 8:
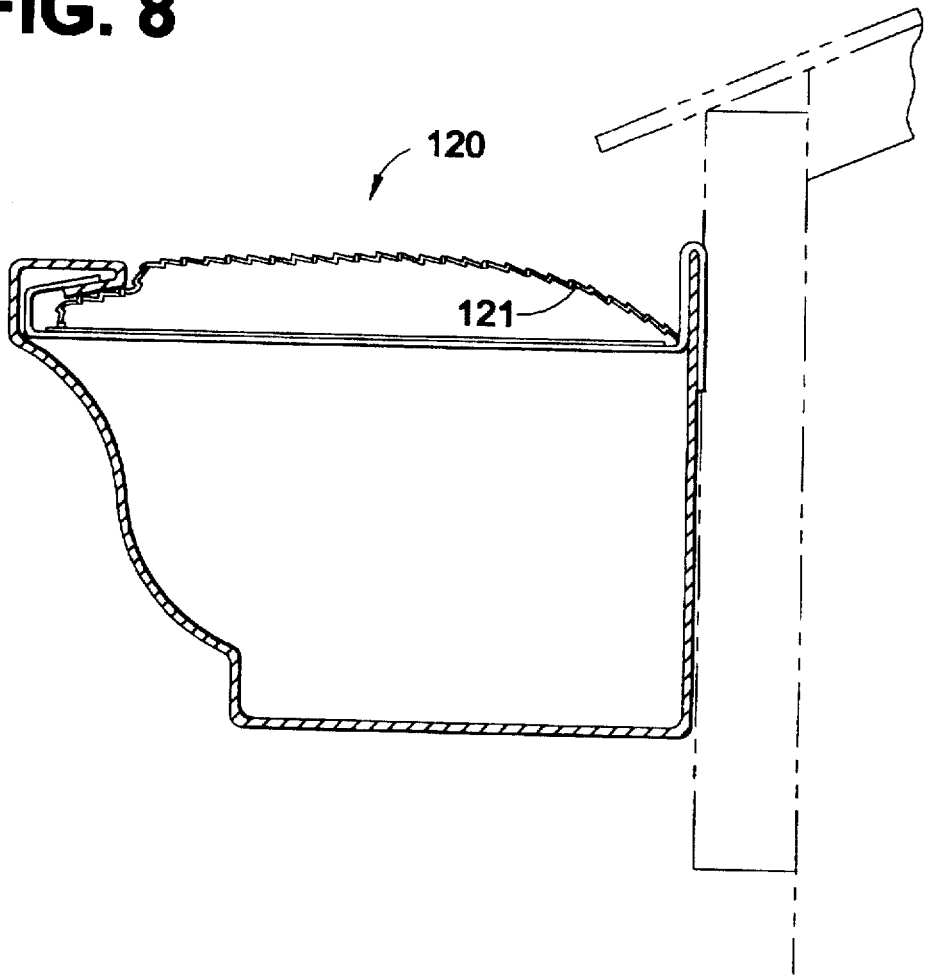
FIG. 8 is a transverse cross-sectional view of a eighth embodiment of a gutter screen of the present invention installed on a gutter.
Figure 8A:
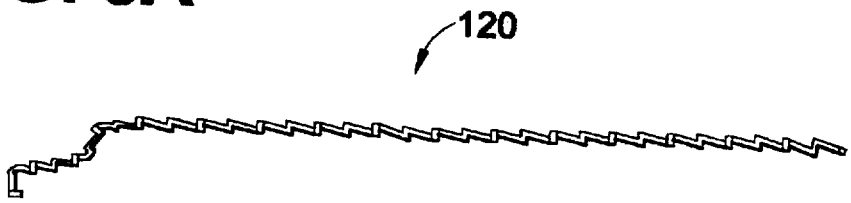
FIG. 8A is a transverse cross-sectional view of the gutter screen of FIG. 8.

An eighth embodiment of a gutter screen of the present invention is generally indicated at 120 and shown in FIGS. 8 and 8A. The gutter screen 120 is similar to the gutter screen 110 shown in FIG. 7, except the rear edge margin 121 does not have a bend.

It is to be understood that the angle of the bends of the gutter screens, and the length of the front edge margin, central portion and rear edge margin may be different than those shown without departing from the scope of this invention. Furthermore, the different configuration front edge margins may be combined with the various rear edge margins shown in FIGS. 1–8.

In order to install the gutter screen 10 of FIG. 1 for example, the rear edge 50 of the gutter screen is placed against the rear corner 34 of the hanger 24 adjacent the back wall 16 of the gutter 12. The front edge margin 44 is then pushed towards the rear edge margin 46 to form an arcuate central portion 42 and then pushed down below the front flange 22 of the gutter 12. The gutter screen 10 is released and the front edge margin 44 springs into engagement with the rearward edge portion 54 of the gutter flange 22.

It will be observed from the foregoing that the gutter screen of this invention has numerous advantages. Importantly, the gutter screen has no complex bends, thus reducing manufacturing time and costs. Furthermore, the gutter screen is configured to be easily installed in existing gutters and is securely held in place without requiring modification to the gutter or gutter hanger.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A gutter, gutter screen and gutter hanger combination comprising a gutter having front, back and bottom walls and a front flange projecting rearwardly from an upper edge of the front wall of the gutter and extending substantially continuously along the entire length of the gutter, said gutter being supported by at least one gutter hanger, each of said gutter hangers having a hook portion hooking over the back wall of the gutter, a bridging portion extending forward from the hook portion over the bottom of the gutter to a position generally adjacent the front wall of the gutter, and a front portion extending up from the bridging portion in engagement with the front flange of the gutter, said hook and bridging portions being joined to define a first corner adjacent the rear wall of the gutter, a gutter screen covering the gutter for preventing the leaves and the like from falling iinto the gutter, said gutter screen comprising:

an elongate screen member having, as viewed from an end of the screen member, a central portion and integrally formed front and rear edge margins on opposite sides of the central portion terminating in front and rear edges, respectively, said screen member being resiliently bent to an arcuate configuration and installed in the gutter in a position wherein (1) the front edge margin of the screen member is in upward pressure engagement with a rearward edge portion of the gutter flange along a line of engagement spaced rearwardly from the front edge of the screen member, (2) the front edge margin of the gutter screen curves continuously forwardly and downwardly from said line of engagement to the front edge of the gutter screen, the front edge being in engagement with the gutter hanger, and (3) the rear edge margin of the screen member extends downwardly from the central portion and the rear edge of the screen member is in pressure engagement with the first corner of the hanger adjacent the rear wall of the gutter, said pressure engagement of the screen member with said gutter flange and with the gutter hanger serving to releasably hold the gutter screen in a position in which it extends as a continuously curved arch curving up and away from the gutter from said front edge of the gutter screen to said rear edge margin of the gutter screen.

2. A gutter screen as set forth in claim 1 wherein said screen member is a wire screen member.

3. A gutter screen as set forth in claim 1 wherein said rear edge margin is bent at an angle of between 100 and 120 degrees with respect to the central portion.

4. A gutter screen as set forth in claim 1 wherein said rear edge margin is bent at an angle of approximately 90 degrees with respect to the central portion.

5. A gutter screen as set forth in claim 1 wherein the front edge of the gutter screen engages the bridging portion of the gutter hanger.

6. A gutter screen as set forth in claim 1 wherein the front edge of the gutter screen engages the front portion of the gutter hanger.

7. A gutter screen adapted for covering a gutter and preventing leaves and the like from falling into the gutter, said gutter having front, back and bottom walls and a front flange projecting rearwardly from an upper edge of the front wall of the gutter and extending substantially continuously along the entire length of the gutter, said gutter being supported by at least one gutter hanger having a hook portion for hooking over the back wall of the gutter, a bridging portion extending forward from the hook portion over the bottom of the gutter to a position generally adjacent the front wall of the gutter, and a front portion extending up from the bridging portion for engagement with the front flange of the gutter, said hook and bridging portions being joined to define a first corner adjacent the rear wall of the gutter, said gutter screen comprising:

an elongate screen member having, as viewed from an end of the screen member, a central portion and integrally formed front and rear edge margins on opposite sides of the central portion terminating in front and rear edges, respectively, the configuration of the screen member being such that when the screen member is unstressed, said front edge margin is bent with respect to the central portion along a bend line extending lengthwise of the screen member so that the front edge margin extends forwardly and downwardly from the central portion to form a continuous unbent generally planar stretch of screen reaching from said bend line all the way to said front edge of the screen member, and said rear edge margin is bent at an obtuse angle with respect to the central portion so that it extends downwardly from the central portion to form a continuous unbent generally planar stretch of screen reaching from the central portion all the way to said rear edge of the screen member, said screen member being configured to be resiliently bent to an arcuate configuration and installed in the gutter in a position wherein (1) the front edge margin of the screen member is adapted for upward and forward pressure engagement with a rearward. edge portion of the gutter flange along a line of engagement spaced forward of said bent line and rearward from the front edge of the screen member, (2) the front edge of the gutter screen is adapted to engage the bridging portion of the gutter hanger, and (3) the rear edge of the screen member is adapted for pressure engagement with the first corner of the hanger adjacent the rear wall of the gutter, said pressure engagement of the screen member with said gutter flange and with the gutter hanger serving to releasably hold the gutter screen in position in which it extends as a curved arch curving up and away from the gutter from said front edge of the gutter screen to said rear edge margin of the gutter screen.

8. A gutter screen as set forth in claim 7 wherein said screen member is a wire screen member made from an aluminum alloy steel.

9. A gutter screen as set forth in claim 7 wherein said front edge margin and rear edge margin are bent at an angle of between 100 and 120 degrees with respect to the central portion.

10. A gutter screen adapted for covering a gutter and preventing leaves and the like from falling into the gutter, said gutter having front, back and bottom walls and a front flange projecting rearwardly from an upper edge of the front wall of the gutter and extending substantially continuously along the entire length of the gutter, said gutter being supported by at least one gutter hanger having a hook portion for hooking over the back wall of the gutter, a bridging portion extending forward from the hook portion over the bottom of the gutter to a position generally adjacent the front wall of the gutter, and a front portion extending up from the bridging portion for engagement with the front flange of the gutter, said hook and bridging portions being joined to define a first corner adjacent the rear wall of the gutter, said gutter screen comprising:

an elongate screen member having, as viewed from an end of the screen member, a central portion and integrally formed front and rear edge margins on opposite sides of the central portion terminating in front and rear edges, respectively, said front edge margin having three bends therein forming a back riser portion bent to extend down from said central portion of the gutter screen, an upwardly facing portion extending forwardly from a lower edge of the back riser portion, and a front riser portion bent to extend down from a forward edge of the upwardly facing portion and terminating at said front edge of the gutter screen, said front and back riser portions being connected by said upwardly facing portion to form a step-like configuration, said upwardly facing portion and said front riser portion having an included angle therebetween of more than approximately 90 degrees, said screen member being configured to be resiliently bent to an arcuate configuration and installed in the gutter in a position wherein (1) the back riser portion of the front edge margin of the screen member is adapted for pressure engagement with a rearward edge portion of the gutter flange along a line of engagement spaced rearwardly from the front edge of the screen member, with said upwardly facing portion extending under the gutter flange, (2) the front edge of the gutter screen is adapted to engage the bridging portion of the gutter hanger, and (3) the rear edge margin of the screen member is adapted for pressure engagement with the first corner of the hanger adjacent the rear wall of the gutter, said pressure engagement of the screen member with said gutter flange and with the gutter hanger serving to releasably hold the gutter screen in an arched position over the gutter.

11. A gutter screen as set forth in claim 10 wherein said rear edge margin is bent at an angle of between 100 and 120 degrees with respect to the central portion.

12. A gutter screen as set forth in claim 10 wherein the configuration of the screen member is such that when the screen member is unstressed, said rear edge margin is bent with respect to the central portion so that it extends downwardly from the central portion to form a continuous unbent generally planar stretch of screen reaching from the central portion all the way to said rear edge margin of the screen member.

13. A gutter screen as set forth in claim 10 wherein the configuration of the screen member is such that when the screen member is unstressed, said rear edge margin and central portion combine to form a flat continuous unbent generally planar stretch of screen reaching from the front edge margin across the central portion all the way to said rear edge of the screen member.

* * * * *